United States Patent [19]

Saito et al.

[11] 4,142,496

[45] Mar. 6, 1979

[54] EXHAUST GAS RECIRCULATION SYSTEM

[75] Inventors: Masaaki Saito, Yokosuka; Akihiro Ohnishi, Kitamoto, both of Japan

[73] Assignee: Nissan Motor Company, Limited, Yokohama, Japan

[21] Appl. No.: 784,446

[22] Filed: Apr. 4, 1977

[30] Foreign Application Priority Data

Apr. 5, 1976 [JP] Japan ..... 51/37989

[51] Int. Cl.[2] ..... F02M 25/06

[52] U.S. Cl. ..... 123/119 A; 137/627.5

[58] Field of Search ..... 123/119 A; 137/627.5

[56] References Cited

U.S. PATENT DOCUMENTS

| | | | |
|---|---|---|---|
| 3,621,825 | 11/1971 | Ojala | 123/119 A |
| 3,783,847 | 1/1974 | Kolody | 123/119 A |
| 3,800,764 | 4/1974 | Goto et al. | 123/119 A |
| 3,828,747 | 8/1974 | Nambu | 123/119 A |
| 3,994,269 | 11/1976 | Takaoka et al. | 123/119 A |
| 3,996,905 | 12/1976 | Dawson | 137/627.5 |
| 4,056,083 | 11/1977 | Wakita | 123/119 A |
| 4,058,098 | 11/1977 | Onaka | 123/119 A |
| 4,066,056 | 1/1978 | Nohira et al. | 123/119 A |

*Primary Examiner*—Charles J. Myhre
*Assistant Examiner*—Craig R. Feinberg

[57] ABSTRACT

Two thermally operated control valves which, in cooperation with each other, admit into the vacuum chamber of the diaphragm unit for the EGR control valve atmospheric air only during cold engine operation, both atmospheric air and engine suction vacuum during engine warming-up operation, and engine suction vacuum only during engine normal operation.

10 Claims, 9 Drawing Figures

EXHAUST GAS RECIRCULATION SYSTEM

BACKGROUND OF THE INVENTION

1. Field of the Invention

The present invention relates generally to an exhaust gas recirculation (EGR) system for feeding engine exhaust gas into an engine intake system to reduce the production of nitrogen oxides (NOx) and particularly to an EGR system of this type which is provided with valve means for admitting both the atmospheric air and an engine suction vacuum into the vacuum chamber of the diaphragm unit for the EGR control valve during engine warming-up operation to have the EGR control valve control the flow of recirculated engine exhaust gas to a proper value less than during engine normal operation after the completion of engine warming-up.

2. Description of the Prior Art

As is well known in the art, an exhaust gas recirculation (EGR) system for an internal combustion engine serves to reduce the production of nitrogen oxides by controlling the maximum combustion temperature in an engine combustion chamber a certain degree by recirculating or feeding into an air-fuel mixture drawn by the engine a portion of exhaust gas emitted from the engine. Although the effect of reducing the production of nitrogen oxides is heightened by increasing the flow of engine exhaust gas recirculated into the air-fuel mixture, the fuel economy and operating performance of the engine are degraded. For solving such a problem, the EGR system is usually provided in the EGR passageway with an EGR control valve operated in response to variations in a suction vacuum of the engine and controlling the flow of recirculated engine exhaust gas in accordance with an operating condition of the engine. However, when the engine exhaust gas is fed into the engine air-fuel mixture under the control of the EGR control valve during engine warming-up condition in which the engine is not sufficiently warmed up, the combustion of the air-fuel mixture is degraded not only to produce engine exhaust gas containing large quantities of hydrocarbons (HC) and carbon monoxide (CO) but also to considerably reduce the output performance and fuel economy of the engine. As a solution of such a problem, when a restriction is provided in a passage conducting a suction vacuum into a vacuum chamber of the EGR control valve, the restriction merely serves to conduct the suction vacuum into the vacuum chamber with a time delay during the warming-up operation of the engine and can not be expected to control the flow of recirculated engine exhaust gas to a value proper for the engine warming-up operation. On the contrary, since the suction vacuum is conducted into the vacuum chamber with a time delay even after completion of the warming-up of the engine, the response of the EGR control valve to variations in the suction vacuum is delayed during normal operating conditions of the engine to lower the effect of reducing the production of nitrogen oxides. Thus, a conventional EGR system has been arranged to stop the EGR during the engine warming-up operation because of difficulty in controlling the flow of recirculated engine exhaust gas. Accordingly, the conventional EGR system has had a drawback that it can not display the effect of reducing the production of nitrogen oxides during the engine warming-up operation.

SUMMARY OF THE INVENTION

It is, therefore, an object of the invention to provide an EGR system improved to effect the EGR by having the EGR control valve control the flow of recirculated engine exhaust gas to an adequate value during the engine warming-up operation so that the EGR system exhibits the effect of reducing the production of nitrogen oxides even during the engine warming-up operation.

This object is accomplished by providing the EGR system with two thermally operated control valves for, in cooperation with each other, admitting into the vacuum chamber of the diaphragm unit for the EGR control valve only atmospheric air during cold engine conditions or operation at an engine temperature below a first predetermined value to have the EGR control valve stop the EGR, both the atmospheric air and an engine suction vacuum during engine warming-up operation at an engine temperature above the first predetermined value and below a second predetermined value to have the EGR control valve control the flow of recirculated engine exhaust gas to a proper value less than during engine normal operation, and only the engine suction vacuum during the engine normal operation at an engine temperature above the second predetermined value to normally have the EGR control valve perform the EGR.

BRIEF DESCRIPTION OF THE DRAWINGS

This and other features and advantages of the invention will become more apparent from the following detailed description taken in connection with the accompanying drawings in which.

DESCRIPTION OF THE PREFERRED EMBODIMENTS

Figure 1:
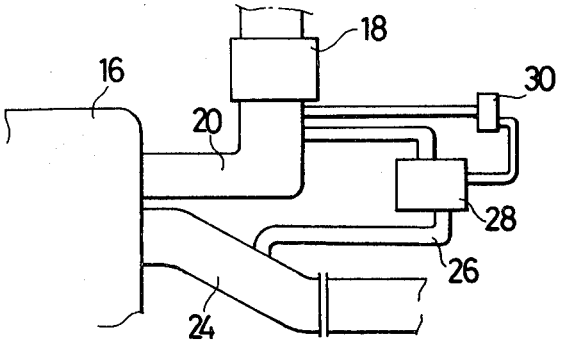
FIG. 1 is a schematic view of a construction and arrangement of an exhaust gas recirculation (EGR) system according to the invention.

Referring to FIG. 1 of the drawings, there is shown an exhaust gas recirculation (EGR) system according to the invention. The EGR system is shown as being combined with an internal combustion engine 16 including a carburetor 18, an intake passageway 20 providing communication between the atmosphere and the engine 16 through the carburetor 18 to conduct air into the engine 16 and having a throttle valve (not shown) rotatably mounted therein, and an exhaust gas passageway 24 providing communication between the engine 16 and the atmosphere for conducting exhaust gas from the engine 16 to the atmosphere. The EGR system comprises an EGR passageway 26 providing communication between intake and exhaust systems of the engine 16, for example, the intake passageway 20 downstream of the throttle valve and the exhaust gas passageway 24 for recirculating or feeding engine exhaust gas into the intake system, an EGR control valve assembly 28 disposed in the EGR passageway 26 and operated by a pressure in the intake passageway 20, and pressure or vacuum control means 30 for controlling in accordance with an operating condition of the engine 16 the pressure for operating the EGR control valve assembly 28.

Figure 2:
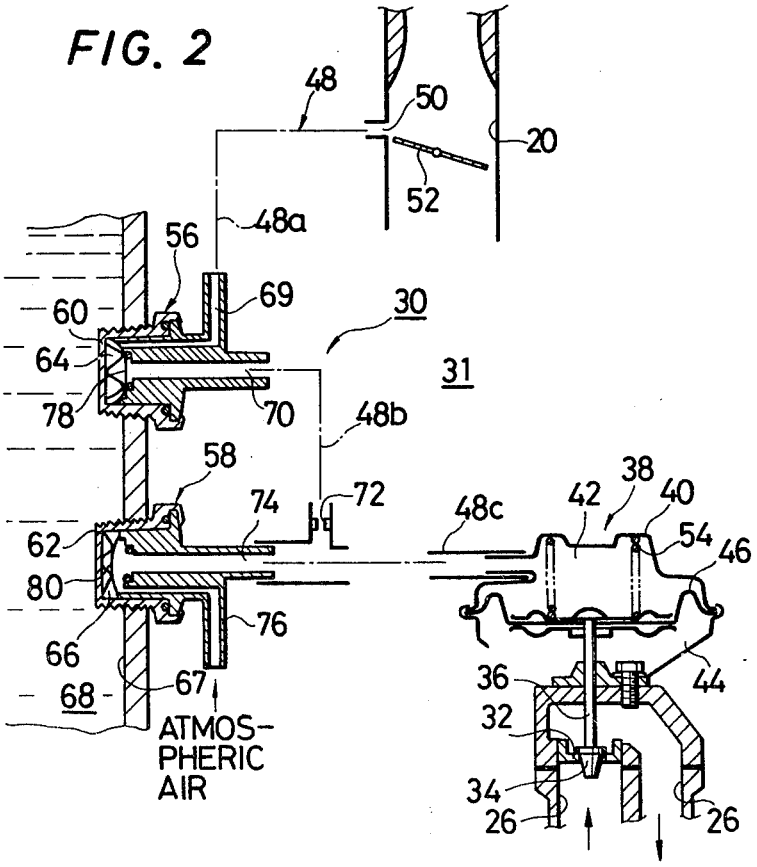
FIG. 2 is a schematic view of a first preferred embodiment of an EGR system according to the invention.

Referring to FIG. 2 of the drawings, there is shown an EGR system according to the invention which is generally designated by the reference numeral 31. The EGR control valve assembly 28 comprises a valve seat 32 formed in the EGR passageway 26, an EGR control valve 34 located movably relative to the valve seat 32, a valve stem 36 extending from the EGR control valve 34 externally of the EGR passageway 26, and means 38 for operating the EGR control valve 34. The operating means 38 comprising a diaphragm unit including a housing 40 having first and second fluid chambers 42 and 44, a flexible diaphragm 46 separating the first and second chambers 42 and 44 from each other. The first chamber 42 communicates through passage means 48 with an EGR port 50 which opens into the intake passageway 20 just upstream of the peripheral edge of a throttle valve 52 in its fully closed position so that the location of the EGR port 50 is varied from the atmospheric side of the throttle valve 52 to the vacuum side thereof as the throttle valve 52 is rotated to increase the degree of opening. The second chamber 44 communicates with the atmosphere. The diaphragm 46 is operatively connected to the valve stem 36 so that the EGR control valve 34 varies the effective cross sectional area of the EGR passageway 26 in accordance with the pressure in the first chamber 42 and accordingly controls the flow of engine exhaust gas into the intake system in accordance with the momentary operating condition of the engine. A balance spring 54 is provided to urge the diaphragm 46 in a direction opposed by the pressure in the second chamber 44.

The pressure control means 30 comprises first and second thermally operated control valve assemblies 56 and 58 which control in cooperation with each other the pressure in the first chamber 42 to a suitable value within a range from a suction vacuum in the intake passageway 20 to atmospheric pressure in accordance with the temperature of the engine 16. The first and second thermally operated control valve assemblies 56 and 58 comprise casings 60 and 62 having therein valve chambers 64 and 66, respectively. Each of the casings 60 and 62 is fixedly secured to, for example, a passage 67 of a coolant 68 of the engine 16 in this embodiment and has a portion made of a good heat conductive material and in contact with, for example, the engine coolant 68 to be sensitive to the temperature of the engine 16 and to conduct the engine temperature to the corresponding valve chamber 64, 66. It is assumed that the engine temperature in the warming-up condition of the engine 16 is represented by a temperature of the engine coolant 68 which is within a predetermined range of, for example, 35° to 60° C. in this embodiment. The valve chamber 64 is located in the passage 48 and has ports 69 and 70 both opening into the chamber 64 and communicating respectively with the EGR port 50 through a passage **48*a* and with the first chamber 42 through passages 48*b* and 48*c*. Each of the passages 48*a*, 48*b* and 48*c* forms part of the passage means 48. The passage 48*b* is formed therein with an orifice or restriction 72. The valve chamber 66 has ports 74 and 76 both opening into the chamber 66 and communicating respectively with the passages 48*b* and 48*c* and with the atmosphere. Alternatively, the port 74 may communicate with the passage 48*a***.

Figure 3:
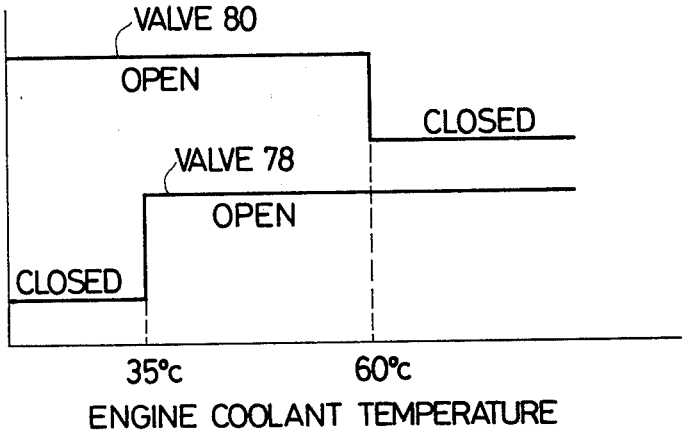
FIG. 3 is a graphic representation of operating temperature characteristics of two thermally operated control valves forming part of the EGR system shown in FIG. 2.

First and second thermally operated control valves 78 and 80 are disposed respectively in the valve chambers 64 and 66 and each are made of bimetal. The first control valve 78 serves to control communication between the ports 69 and 70 in response to the engine temperature and is set to have temperature operative characteristics as shown in FIG. 3 that it closes and opens the passage 48 to obsruct and provide communication between the ports 69 and 70 when the temperature of the engine coolant 68 is below and above the minimum 35° C. of the predetermined range, respectively. The second control valve 80 serves to control communication between the ports 74 and 76 in response to the engine temperature and is set to have temperature operative characteristics as shown in FIG. 3 that it is opened and closed to provide and obstruct communication between the ports 74 and 76 when the temperature of the engine coolant 68 is below and above the maximum 60° C. of the predetermined range, respectively.

The EGR system 31 thus described is operated as follows:

When the engine 16 is in a cold condition in which the temperature of the engine coolant 68 is below the predetermined value 35° C. as during starting operation of the engine 16 and as at the initial stage after starting of the engine 16, the first valve 78 closes the passage 48 to inhibit admission of a suction vacuum in the intake passageway 20 into the chamber 42 of the diaphragm assembly 38, while the second valve 80 is opened to admit atmospheric air into the chamber 42. As a result, the diaphragm 46 is forced by the balance spring 54 into a position in which the EGR control valve 34 closes the EGR passageway 26. Accordingly, at the cold condition of the engine 16, the feed of engine exhaust gas into the intake system is stopped as an ordinary EGR system to prevent running of the engine 16 from being stopped after starting thereof and to ensure the stability of operation of the engine 16 at the initial stage.

When the temperature of the engine coolant 68 is increased above the predetermined value 35° C., the first valve 78 opens the passage 48 to admit a suction vacuum in the intake passage 20 into the chamber 42, while the second valve 80 is kept opened until the temperature of the engine coolant 68 reaches the predetermined value of 60° C. Accordingly, the suction vacuum fed into the chamber 42 is diluted or reduced by the atmospheric air fed into the chamber 42 through the second valve 80 under the warming-up condition of the engine 16. As a result, the EGR control valve 34 is operated in accordance with variations in the suction vacuum under a condition in which the EGR control valve 34 reduces the effective cross sectional area of the EGR passageway 26 as compared with normal conditions when the chamber 42 is fed with only the suction vacuum. Accordingly, the amount of engine exhaust gas fed into the intake system is reduced to an appropriate value as compared with the normal conditions to make it possible for the EGR system 10 to exhibit the effect of reducing the production of nitrogen oxides (NOx) by combustion in the engine 16 during warming-up operation thereof without reducing the output performance and the fuel economy of the engine 16 and causing the production of large quantities of hydrocarbons (HC) and carbon monoxide (CO).

When the temperature of the engine coolant 68 is increased above the predetermined value of 60° C. and the warming-up of the engine 16 is completed, the first valve 78 remains opened, while the second valve 80 is closed to inhibit admission of atmospheric air into the chamber 42 so that the chamber 42 is normally fed with only the suction vacuum. Accordingly, when the engine 16 has been warmed-up, the EGR system 10 feeds the engine exhaust gas into the intake system in accordance with the momentary operating condition of the engine 16 to satisfactorily perform the effect of reducing the production of nitrogen oxides (NOx) by the engine 16 similarly to a common EGR system.

Figure 4:
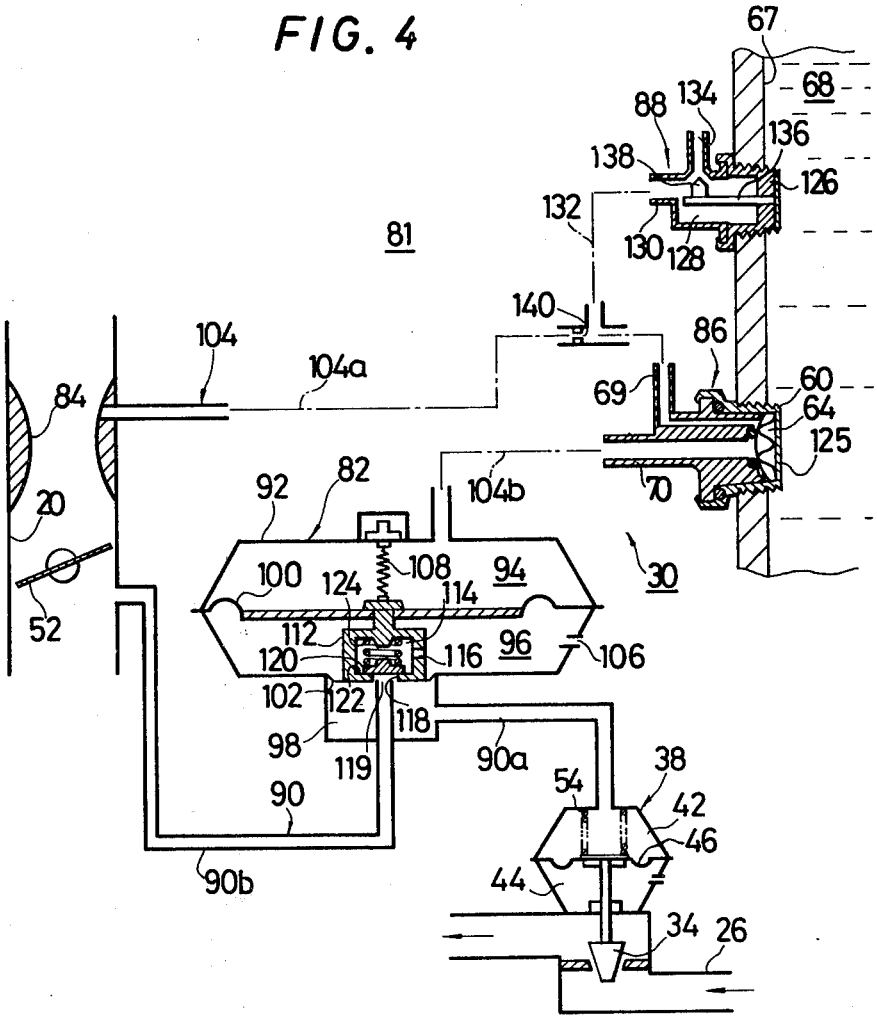
FIG. 4 is a schematic view of a second preferred embodiment of an EGR system according to the invention.

Referring to FIG. 4 of the drawings, there is shown an EGR system according to the invention which is generally designated by the reference numeral 81. In FIG. 4, similar components elements and parts are designated by the same reference numerals as those used in FIG. 2. In this embodiment, the pressure control means 30 comprises a check valve assembly 82 operated in response to a vacuum produced in a venturi 84 formed in the intake passageway 20 upstream of the throttle valve 52, and first and second thermally operated control valve assemblies 86 and 88.

The vacuum operated check valve assembly 82 is disposed in passage means 90 which provides communication between the chamber 42 of the diaphragm assembly 38 for the EGR control valve 34 and the intake passageway 20. The check valve assembly 82 comprises a casing 92 having therein first, second and third chambers 94, 96 and 98, a first flexible diaphragm 100 separating the chambers 94 and 96 from each other, and a second flexible diaphragm 102 separating the chambers 96 and 98 from each other and having an effective working surface area smaller than that of the diaphragm 100. The first chamber 94 communicates with the venturi 84 through a passage 104, the second chamber 96 communicates with the atmospheric through an opening 106, and the third chamber 98 communicates with the chamber 42 through a passage 90*a*. A spring 108 is provided to urge the diaphragm 100 in a direction opposed by the pressure in the chamber 96. A housing 112 is located in the second chamber 96 and is fixedly secured to the diaphragms 100 and 102. The housing 112 has therein a valve chamber 114 and is formed therethrough with an aperture 116 which provides communication between the chambers 96 and 114. The diaphragm 102 and the housing 112 secured to each other are formed therethrough with an aperture 118 which provides communication between the chambers 98 and 114. A conduit 90*b* communicates at one end with the intake passageway 20 downstream of the throttle valve 52 and the other end 119 of the conduit 90*b* extends into the chamber 98 perpendicular to the diaphragm 102 and terminates in the aperture 118. The cross sectional area or diameter of the aperture 118 is larger than the external cross sectional area or diameter of the conduit 90*b* located in the chamber 98 so that a clearance is provided between the conduit 90*b* and both the diaphragm 102 and the housing 112. Each of the passage 90*a* and the conduit 90*b* forms part of the passage means 90. A check valve 120 is located in the valve chamber 114 movably relative to the aperture 118 and is normally seated on a valve seat 122 formed by that internal wall surface of the housing 112 which defines the aperture 118 so that the check valve 120 closes the aperture 118 and confronts the free end 119 of the conduit 90*b*. The check valve 120 is normally spaced apart from the open end 119 of the conduit 90*b* to open same. The spring 108 is set so that the diaphragms 100 and 102 are located in a position in which the control valve 120 closes the open end 119 when the vacuum in the chamber 94 is relatively low. A spring 124 is provided to push the check valve 120 against the valve seat 122. The force of the spring 124 is set so that, when the diaphragm 100 and therefore the diaphragm 102 and the housing 112 are moved toward the conduit 90*b* to engage the check valve 120 with the open end 119 of the conduit 90*b* to close same, the spring 124 allows the conduit 90*b* to unseat the check valve 120 from the valve seat 122 and to project into the chamber 114 to open the aperture 118 to provide communication between the chambers 98 and 114.

The vacuum operated check valve assembly 82 thus described is operated as follows.

When a vacuum fed from the venturi 84 into the chamber 94 is reduced to a relatively low value, the diaphragms 100 and 102 are forced toward the conduit 90*b*, the check valve 120 is closed to or is brought into contact with the free end 119 of the conduit 90*b* to limit or obstruct communication between the intake passageway 20 and the chamber 42. As a result, the feed of a suction vacuum into the chamber 42 is limited or stopped to reduce the vacuum in the chamber 42. When the venturi vacuum in the chamber 94 is further reduced to a lower value, the diaphragms 100 and 102 are further forced into a position in which the check valve 120 is pushed up from the valve seat 122 by the free end 119 of the conduit 90*b* to open the aperture 118 to admit atmospheric air from the chamber 96 into the chamber 98 through the aperture 116 and the chamber 114. As a result, the pressure in the chamber 98 and therefore the chamber 42 approaches the atmospheric pressure to cause the EGR control valve 34 to close the EGR passageway 26. On the contrary, when the venturi vacuum in the chamber 94 is increased, the diaphragms 100 and 102 are displaced away from the conduit 90*b* so that the check valve 120 opens the conduit 90*b* to admit the suction vacuum from the intake passageway 20 into the chambers 98 and 42. The diaphragms 100 and 102 are moved due to an increase in the vacuum in the chamber 98 into a position in which the control valve 120 reduces the degree of opening of the open end 119. By the repetition of such an operation, the diaphragms 100 and 102 are converged into a position in which the forces biasing same in opposite directions are balanced. The check valve assembly 82 thus serves to convert or amplify in accordance with the differential area of the diaphragms 100 and 102 the venturi vacuum in the chamber 94 into the suction vacuum to have the EGR control valve 34 control the flow of engine exhaust gas into the intake system in accordance with an operating condition of the engine 16.

The first bimetal valve assembly 86 is similar to the bimetal valve assembly 56 shown in and described with reference to FIG. 2 but a first bimetal valve 125 similar to the bimetal valve 78 is disposed in the passage means 104 and the port 69 communicates with the venturi 84 through a passage 104*a*, while the port 70 communicates with the chamber 94 through a passage 104*b*. The bimetal valve 125 controls communication between the passages 104*a* and 104*b*.

The second bimetal valve assembly 88 comprises a housing 126 having therein a valve chamber 128. The housing 126 is fixedly secured to, for example, the engine coolant passage 67 and has a portion made of a good heat conductive material and contacting with, for example, the engine coolant 68 to sense the temperature of the engine 16 and to conduct the sensed engine temperature to the value chamber 128. The valve chamber 128 has a first port 130 which provides communication between the passage 104*a* and the valve chamber 128 through a passage 132 and a second port 134 which provides communication between the atmosphere and the valve chamber 128. A second bimetal valve 136 is disposed in the valve chamber 128 and is made of bimetal. The bimetal valve 136 is fixedly secured at one end to the portion of the housing 126 which senses the engine temperature. The bimetal valve 136 has a free end forming a valve section 138 which is located movably relative to the second port 134 and is moved to gradually reduce the effective cross sectional area of the second port 134 with increases in the temperature of the temperature sensing portion of the housing 126. An orifice or restriction 140 is formed in the passage 104*a* on the venturi side of the junction of the passages 104*a* and 132.

Figure 5:
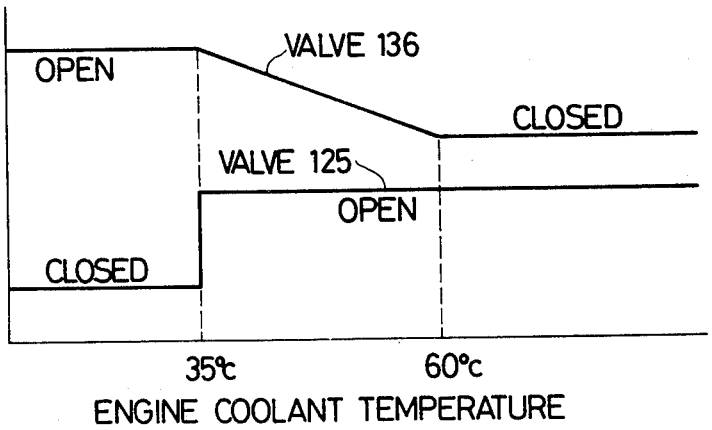
FIG. 5 is a graphic representation of operating temperature characteristics of two thermally operated control valves forming part of the EGR system shown in FIG. 4.

It is assumed that the engine temperature during the warming-up operation of the engine 16 is represented by a temperature of the engine coolant 68 which is within the predetermined range of 35° to 60° C. also in this embodiment similarly to the embodiment shown in FIG. 2. The first bimetal valve 125 is set to have operating temperature characteristics as shown in FIG. 5 that it closes and opens the passage 104 when the temperature of the engine coolant 68 is below and above the minimum 35° C. of the predetermined temperature range, respectively. The second bimetal valve 136 is set to have an operating temperature characteristics as shown in FIG. 5 that it starts to close the second port 134 when the engine coolant temperature is increased to the minimum 35° C. of the predetermined range and that it fully closes the second port 134 when the engine coolant temperature is increased to the maximum 60° C. of the predetermined range.

The EGR system 81 thus described is operated as follows:

When the engine 16 is started in a cold condition in which the temperature of the engine coolant 68 is below the minimum 35° C. of the predetermined temperature range, the first bimetal valve 125 is closed to obstruct communication between the passages 104*a* and 104*b* and the pressure in the chamber 94 is maintained at atmospheric pressure. As a result, the diaphragms 100 and 102 are displaced by the pressure in the chamber 94 into the position in which the check valve 120 contacts with the free end 119 of the conduit 90*b* to close same and is unseated from the valve seat 122 by the conduit 90*b* to open the aperture 118. Accordingly, the atmosphere is fed into the chamber 42 through the aperture 116 and the chambers 114 and 98 to cause the EGR control valve 34 to close the EGR passageway 26.

When the temperature of the engine coolant 68 is increased to the minimum 35° C. of the predetermined temperature range, the first bimetal valve 125 is opened to provide communication between the passages 104*a* and 104*b* to admit a venturi vacuum into the chamber 94. Concurrently, the atmospheric air is fed into the chamber 94 through the port 134 the effective cross sectional area of which is gradually reduced by the second bimetal valve 136 until the temperature of the engine coolant 68 reaches the maximum 60° C. of the predetermined temperature range. Accordingly, the venturi vacuum fed into the chamber 94 is bled off or diluted by the atmospheric air during the warming-up operation of the engine 16. As a result, the check valve 120 is positioned closer to the free end 119 of the conduit 90*b* to admit a reduced suction vacuum into the chamber 42 to reduce the flow of engine exhaust gas fed into the intake system as compared with normal operation when the venturi vacuum only is admitted into the chamber 94. Thus, a proper quantity of engine exhaust gas is fed into the intake system during the engine warming-up operation. In this embodiment, since the second bimetal valve 136 gradually reduces the flow of atmospheric air admitted into the chamber 94 in accordance with increases in the temperature of the engine 16 during the engine warming-up operation, an advantages is obtained that engine exhaust gas matched with warm-up condition of the engine 16 is recirculated.

When the temperature of the engine coolant 68 is increased to the maximum 60° C. of the predetermined temperature range to complete the warming-up of the engine 16, the first bimetal valve 125 remains open and the second bimetal valve 136 is fully closed. As a result, the venturi vacuum only is admitted into the chamber 94 to move the diaphragm 100 and 102 into a position in which the check valve 120 is spaced apart from the free end 119 of the conduit 90*b*. Accordingly, the suction vacuum only is admitted into the chamber 42 to cause the EGR control valve 34 to normally control the flow of the recirculated engine exhaust gas in accordance with the engine operating condition.

Figure 6A:
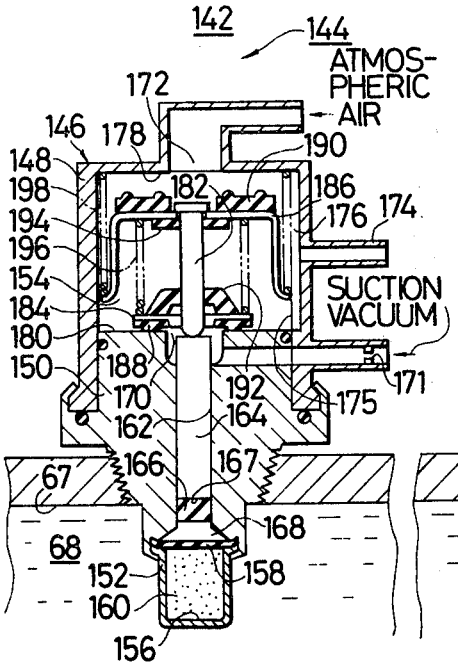
FIGS. 6(A) to 6(C) are schematic views of a third preferred embodiment of a part of an EGR system according to the invention.
Figure 6B:
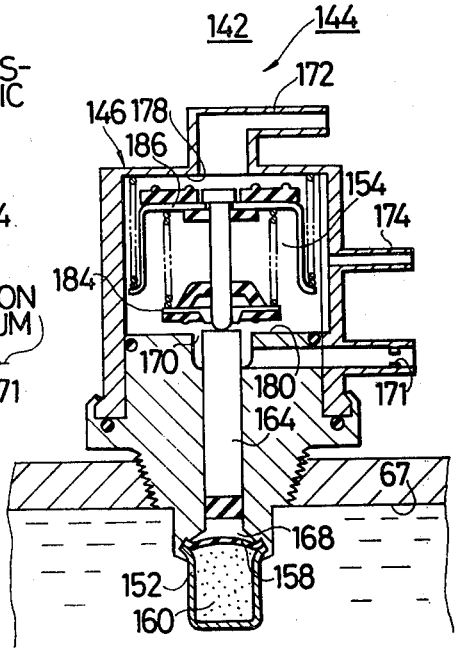
Figure 6C:
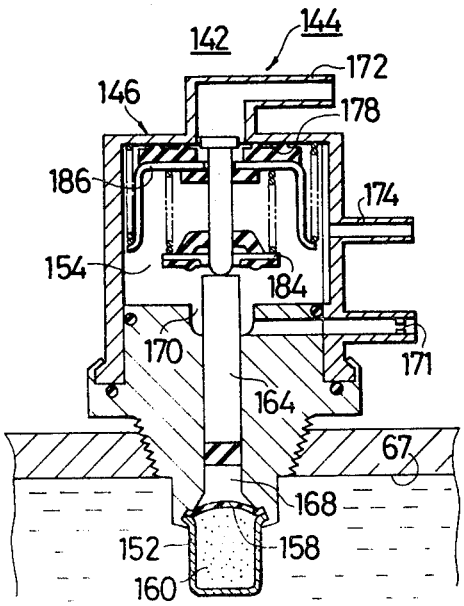
Figure 7:
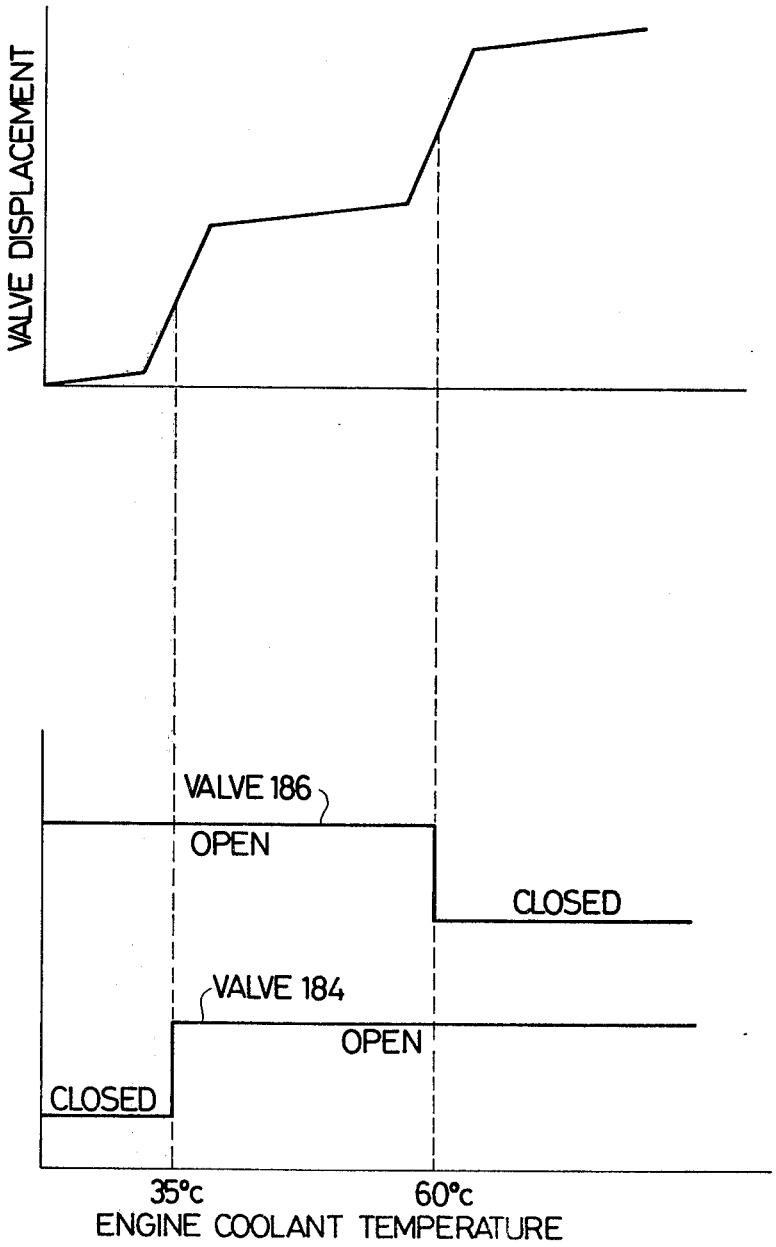
FIG. 7 is a graphic representation of operating temperature characteristics of two thermally operated control valves forming part of the EGR system shown in FIGS. 6(A) to 6(C) and the relationship of the temperature characteristics and the displacement of the control valves.

Referring to FIGS. 6(A) to 6(C) of the drawings, there is shown a part of an EGR system according to the invention which is generally designated by the reference numeral 142. In FIGS. 6(A) to 6(C), like component parts are designated by the same reference numerals as those used in FIG. 2. There are omitted in FIGS. 6(A) to 6(C) the illustrations of the EGR control valve 34, the means 38 for operating the EGR control valve 34, and the intake passageway 20 having the throttle valve 52.

The pressure control means 30 comprises in this embodiment a combined thermally operated control valve assembly 144 comprising a housing 146 which is fixedly secured to, for example, the engine coolant passage 67 and includes first, second and third sections 148, 150 and 152. The first and second sections 148 and 150 define therebetween a valve chamber 154. The third section 152 is made of a good heat conductive material and has therein a chamber 156 having an open end. The third section 152 is arranged to contact with, for example, the engine coolant 68 in this embodiment to be sensitive to the temperature of the engine 16 and to conduct the engine temperature into the chamber 156. A flexible diaphragm 158 is fixedly secured to the third section 152 to cover the open end of the chamber 156 and to define the chamber 156 together with the third section 152. The chamber 156 is filled therein with a mixture 160 of two kinds of thermowaxes which have different melting temperatures and sense the engine temperature transmitted from the section 152. The second section 150 is formed therethrough with an elongate aperture 162 which communicates at one end with the valve chamber 154 and at the other end with the diaghragm 158. An operating rod 164 is slidably located in the elongate aperture 162. A sealing member 166 is located in the elongate aperture 162 to contact with the end 167 on the diaphragm 158 side of the operating rod 164. A space is provided in the elongate aperture 162 between the diaphragm 158 and the sealing member 166 and is fillled therein with a silicone oil 168 which serves as a working medium. The expansion and contraction of the mixture 160 due to variations in the engine temperature are transmitted to the operating rod 164 by way of the diaphragm 158 and the silicone oil 168 to axially slide the operating rod 164 in opposite directions.

The second section 150 has a port 170 which provides communication between the valve chamber 154 and the intake passageway 20 downstream of the throttle valve 52 through an orifice 171. The first section 148 has a port 172 which provides communication between the valve chamber 154 and the atmosphere and a port 174 which provides communication between the valve chamber 154 and the chamber 42 of the diaphragm unit 38 of the EGR control valve 34. The first section 148 is formed in an internal side wall 175 thereof with a groove 176 which opens into the valve chamber 154 and communicates with the port 174 and extends to an internal end wall 178 of the first section 148 having the port 172 and to an end wall 180 of the second section 150 having the port 170 and confronting the end wall 178. A valve stem 182 is axially movably located in the valve chamber 154 and contacts at one end with the end on the valve chamber side of the operating rod 164 and extends at the other end toward the end wall 178 of the first section 148. A control valve 184 is disposed in the valve chamber 154 to open and close the port 170 and is fixedly secured to the valve stem 182. A control valve 186 is disposed in the valve chamber 154 to open end close the port 172 and is located on the valve stem 182 slidably relative to the valve stem 182. Sealing members 188 and 190 are fixedly secured respectively to the surfaces of the control valves 184 and 186 which confront tne end walls 180 and 178. The sealing members 188 and 190 contact with the end walls 180 and 178 to seal the valve chamber 154 from the ports 170 and 172 when the control valves 184 and 186 close the ports 170 and 172, respectively. Sealing members 192 and 194 are provided respectively for sealing those portions of the control valves 184 and 186 which are passed through by the valve stem 182. A spring 196 is interposed between the control valves 184 and 186 to urge the control valve 186 away from the control valve 184. A spring 198 is interposed between the first section 148 and the control valve 186 to urge the valve stem 182 and the control valves 184 and 186 toward the operating rod 164. The force of the spring 198 is smaller than that of the spring 196.

It is assumed that the temperature of the engine 16 in the warming-up condition thereof is represented by a temperature of the engine coolant 68 which is within a predetermined range of, for example, 35° to 60° C. similarly to the EGR systems 31 and 81 of FIGS. 2 and 4. One of the mixed thermowaxes 160 is set to have a melting temperature characteristics that it is abruptly melted and expanded at the minimum 35° C. of the predetermined temperature range of the engine coolant 68, while the other thermowax is set to have a melting temperature characteristics that it is abruptly melted and expanded at the maximum 60° C. of the predetermined temperature range.

The EGR system 142 thus described is operated as follows:

When the engine 16 is in a cold condition in which the temperature of the engine coolant 68 is below the minimum 35° C. of the predetermined temperature range, the thermowax mixture 160 in the chamber 156 is solidified to allow the spring 198 to force the control valves 184 and 186 into a position shown in FIG. 6(A) in which the control valve 184 closes the port 170 to prevent admission of the suction vacuum into the valve chamber 154 but the control valve 186 opens the port 172 to admit the atmospheric air into the valve chamber 154. As a result, the atmospheric air is fed from the valve chamber 154 into the chamber 42 through the port 174 to cuase the EGR control valve 34 to close the EGR passageway 26. Accordingly, the EGR is stopped during the engine cold condition.

When the temperature of the engine coolant 68 is increased to the minimum 35° C. of the predetermined range, the low temperature sensitive thermowax of the mixture 160 is abruptly melted and expanded to axially move the working rod 164 away from the section 152 by means of the diaphragm 158, the silicone oil 168 and the sealing member 166. As a result, the control valves 184 and 186 are forced by the working rod 164 into a position shown in FIG. 6(B) in which the control valves 184 and 186 concurrently open the ports 170 and 172 to admit the suction vacuum and atmospheric air into the valve chamber 154, respectively. Accordingly, the chamber 42 is fed with the suction vacuum reduced to an adequate extent by the atmospheric air so that the EGR control valve 34 controls the flow of recirculated engine exhaust gas in accordance with the vacuum under a condition in which the EGR control valve 34 reduces the effective cross sectional area of the EGR passageway 26 as compared with normal operation when the suction vacuum only is fed into the chamber 42. Accordingly, a proper quantity of engine exhaust gas is recirculated to display the effect of reducing the production of nitrogen oxides (NOx) during the warming-up operation of the engine 16.

When the temperature of the engine coolant 68 is further increased to the maximum 60° C. of the predetermined range to complete the warming-up of the engine 16, the high temperature sensitive thermowax of the mixture 160 is abruptly melted and expanded to further move the working rod 164 away from the section 152. As a result, the control valves 184 and 186 are moved by the working rod 164 into a position shown in FIG. 6(C) in which the control valve 184 continues to opening the port 170 but the control valve 186 closes the port 172 to prevent admission of the atmospheric air into the valve chamber 154. Accordingly, the suction vacuum only is admitted into the chamber 42 so that the EGR control valve 34 normally controls the flow of recirculated engine exhaust gas in accordance with operating conditions of the engine 16 to satisfactorily reduce the production of nitrogen oxides.

When the thermowax mixture 160 is expanded in excess of the degree shown in FIG. 6(C), the valve stem 182 and the control valve 184 are slided relative to the control valve 186 by the working rod 164 away from the port 170 to absorb the excessive expansion of the thermowax mixture 160.

The EGR system 142 has an advantage that, since the vacuum control means 30 comprises a single thermally operated control valve assembly 144, the construction of the system 142 is simplified, and that, since the control valves 184 and 186 are operated by the expansion and contraction of two kinds of thermowaxes, the ports 170 and 172 are surely opened and closed to increase the reliability of the system 142.

Although the invention has been described such that a portion of the casing of each of the thermally operated control valves is located in contact with the engine coolant, the temperature of the engine 16 can be sensed by burying the casing portion in the engine proper, by immersing the casing portion in lubricating oil of the engine 16 or by locating the casing portion in the engine compartment or room.

The flow of engine exhaust gas recirculated during the engine warming-up operation can be set to a certain value by setting to a certain value the effective cross sectional area of the passage of the atmospheric air admitted into the suction vacuum for diluting it and thereby by varying the degree of dilution of the suction vacuum.

It will be thus appreciated that the invention provides an EGR system which controls to a proper value the flow of engine exhaust gas recirculated during the engine warming-up operation so that the effect of reducing the production of nitrogen oxides is sharply increased.

What is claimed is:

1. An exhaust gas recirculation system in combination with an internal combustion engine, comprising:

an exhaust gas recirculation (EGR) passageway for providing communication between exhaust and intake systems of the engine for recirculating into the intake system exhaust gas emitted from the engine;

an EGR control valve disposed in the EGR passageway;

a diaphragm unit having a fluid chamber to receive a suction vacuum of the engine;

a flexible diaphragm defining in part the fluid chamber and operatively connected to the EGR control valve so that the EGR valve controls the flow of recirculated exhaust gas in accordance with a vacuum in said fluid chamber;

first control means for causing the EGR control valve to close the EGR passageway during operation of the engine in which the temperature of the engine is below a first predetermined value and for having the EGR control valve control the flow of recirculated exhaust gas during operation of the engine in which the temperature of the engine is above said first predetermined value by stopping entry of the suction vacuum of the engine into the fluid chamber in response to said operations of the engine in which the temperature of the engine is below said first predetermined value and for allowing entry of the suction vacuum of the engine into the fluid chamber in response to said operations of the engine in which the temperature of the engine is above said first predetermined value; and second control means for having the EGR control valve reduce the flow of recirculated exhaust gas to a proper value during warming-up operation of the engine in which the temperature of the engine is between said first and a second predetermined value by reducing the suction vacuum admitted into the fluid chamber in response to the warming-up operation of the engine.

2. An EGR system as claimed in claim 1, in which said first and second control means comprises a common housing having therein a valve chamber having a first port for admitting the suction vacuum into said valve chamber, a second port providing communication between said valve chamber and the atmosphere, and a third port providing communication between said valve chamber and the fluid chamber, a common valve stem axially movably located in said valve chamber, a first control valve mounted on said valve stem for closing and opening said first port, a second control valve mounted on said valve stem for closing and opening said second port, said valve stem having a first position in which said first control valve closes said first port and said second control valve opens said second port, a second position in which said first and second control valves open said first and second ports, respectively, and a third position in which said first control valve opens said first port and said second control valve closes said second port, operating means for moving said valve stem into said first position in response to a temperature of the engine below said first predetermined value, into said second position in response to a temperature of the engine within the range of said first predetermined value to said second predetermined value, and into said third position in response to a temperature of the engine above said second predetermined value.

3. An EGR system as claimed in claim 2, in which said operating means comprises a mixture of two kinds of thermowaxes sensitive to the temperature of the engine 16, one of said thermowaxes being in a solidified condition and in a molten and expanded condition in response to temperatures of the engine below and above said first predetermined value, respectively and the other thermowax being in a solidified condition and a molten and expanded condition in response to temperatures of the engine below and above said second predetermined value, respectively, and an operating rod connecting said mixture of thermowaxes to said valve stem for moving said valve stem into said first position in response to said solidified condition of said one thermowax, into said second position in response to said molten and expanded condition of said one thermowax only, and into said third position in response to said melting and expansion of said other thermowax.

4. An EGR system as claimed in claim 2, in which said first control valve is fixedly secured to said valve stem and said second control valve is slidably located on said valve stem, and said first and second control means further comprises a first spring interposed between said first and second control valves for urging said second control valve away from said first control valve, and a second spring for urging said second control valve toward said first control valve.

5. An EGR system as claimed in claim 1, further comprising first passage means for conducting the suction vacuum into the fluid chamber, and in which said first control means comprises a first thermally operated control valve disposed in said first passage means and closing and opening said first passage means in response to temperatures of the engine below and above said first predetermined value, respectively, and said second control means comprises second passage means for providing communication between said first passage means and the atmosphere, and a second thermally operated control valve disposed in said second passage means and opening and closing said second passage means in response to temperatures of the engine below and above said second predetermined value, respectively.

6. An EGR control system as claimed in claim 5, in which each of said first and second thermally operated control valves is made of bimetal and comprises a casing having a section for sensing the temperature of the engine, said section being made of a good heat conductive material and accomodating therein the corresponding control valve.

7. An EGR system as claimed in claim 1, further comprising first passage means for conducting the suction vacuum into the fluid chamber, said fluid chamber being communicable with the atmosphere, a check valve disposed in said first passage means and having a first position in which said check valve closes said first passage means and provides communication between the fluid chamber and the atmosphere, a second position in which said check valve opens said first passage means a slight amount and obstructs communication between the fluid chamber and the atmosphere, and a third position in which said check valve opens said first passage means a large amount and obstructs communication between the fluid chamber and the atmosphere, said check valve being movable into said first position in response to a temperature of the engine below said first predetermined value, into said second position in response to a temperature of the engine within the range of said first predetermined value to said second predetermined value and into said third position in response to a temperature of the engine above said second predetermined value.

8. An EGR system as claimed in claim 7, in which said check valve comprises a casing having first, second and third chambers therein, said second chamber communicating with the atmosphere, said third chamber being located in said first passage means and communicating with said fluid chamber, a first pressure sensitive movable partition member separating said first and second chambers from each other, a second pressure sensitive movable partition member separating said second and third chambers from each other and having an effective working surface area smaller than that of said first partition member, said first partition member being operatively connected to said second partition member at a constant distance, said second partition member being formed therethrough with an aperture providing communication between said second and third chambers, a portion of said first passage means extending into said third chamber and having an open end terminating in said aperture for admitting the suction vacuum into said third chamber, said check valve being located in said second chamber and being resiliently held in a position to close said aperture and to confront said open end, and second passage means for providing communication between said first chamber and a venturi formed in an intake passageway of the engine for conducting a venturi vacuum into said first chamber.

9. An EGR system as claimed in claim 8, in which said first control means comprises a first thermally operated control valve disposed in said second passage means and closing and opening said second passage means in response to temperatures of the engine below and above said first predetermined value, respectively, and said second control means comprises third passage means for providing communication between said second passage means between said first control valve and the venturi and the atmosphere, and a second thermally operated control valve disposed in said third passage means and fully opening said third passage means in response to a temperature of the engine below said first predetermined value and gradually closing said third passage means in response to increases in the temperature of the engine from said first predetermined value to said second predetermined value and fully closing said third passage means in response to a temperature of the engine above said second predetermined value, said first partition member being resiliently connected to said check valve so that said check valve is moved by said first partition member and said open end into said first position to open said aperture and to close said open end in response to closing of said second passage means, is moved by said first partition member into said second position to close said aperture and to open said open end a slight amount in response to opening of both said second and third passage means, and is moved by said first partition member into said third position to close said aperture and to open said open end a large amount in response to opening of said second passage means only.

10. An EGR system as claimed in claim 9, in which each of said first and second control valves is made of bimetal and further comprises:

a casing having a section sensitive to the temperature of the engine, said section being made of a good heat conductive material and accommodating the corresponding control valve therein, said second control valve being fixedly secured at one end to said section of said casing and having a free end forming a valve section for closing and opening said third passage means.

* * * * *